US005480060A

United States Patent [19]

Blythe

[11] Patent Number: 5,480,060

[45] Date of Patent: Jan. 2, 1996

[54] SPACE SAVING SYSTEM FOR CORELESS ROLLED WIPERS

[75] Inventor: David A. Blythe, Philadelphia, Pa.

[73] Assignee: Scott Paper Company, Delaware County, Pa.

[21] Appl. No.: 287,553

[22] Filed: Aug. 8, 1994

[51] Int. Cl.[6] ..... B65H 1/00

[52] U.S. Cl. ..... 221/63; 221/45; 206/389

[58] Field of Search ..... 221/63, 33, 45; 206/389, 410, 398, 812; 242/613, 600, 601

[56] References Cited

U.S. PATENT DOCUMENTS

| | | | |
|---|---|---|---|
| 325,410 | 9/1885 | Hicks | 242/565 |
| 1,819,895 | 8/1931 | Hunt | 242/1 |
| 3,704,776 | 12/1972 | Collins | 206/389 |
| 4,762,061 | 8/1988 | Watanabe et al. | 100/35 |
| 4,886,167 | 12/1989 | Dearwester | 206/389 |
| 4,909,388 | 3/1990 | Watanabe | 206/410 |
| 5,027,582 | 7/1991 | Dearwester | 53/399 |
| 5,090,566 | 2/1992 | Yount | 206/389 |
| 5,186,099 | 2/1993 | Qing et al. | 100/35 |
| 5,195,300 | 3/1993 | Kovacs | 53/438 |

FOREIGN PATENT DOCUMENTS 2244472 4/1991 United Kingdom .

*Primary Examiner*—Kenneth Noland
*Attorney, Agent, or Firm*—Woodcock Washburn Kurtz Mackiewicz & Norris

[57] ABSTRACT

A centerflow rolled wiper system for a coreless rolled web which obviated dispensing problems caused by roping of the web during dispensing while simultaneously achieving significant space saving advantages. The coreless rolled web includes a plurality of wipers defined by lines of perforation across the width of the web, each of said wipers having a length L. The initial center hole of the roll has a cross-sectional perimetric dimension which is less than two times L, the roll having been bi-directionally compressed to a generally rectangular cross section. There is a dispenser carton in which the bi-directionally compressed roll resides, the dispenser carton sized to maintain said generally rectangular cross section of the bi-directionally compressed rolled web. A dispensing port through at least one end of the dispenser carton allows a user to withdraw the wipers from the center of the coreless roll.

7 Claims, 2 Drawing Sheets

SPACE SAVING SYSTEM FOR CORELESS ROLLED WIPERS

BACKGROUND OF THE INVENTION

1. Field of the Invention

This invention relates generally to coreless rolled wipers and, more particularly, to individually packaged coreless rolled wiper dispenser systems.

2. Brief Description of the Prior Art

Numerous coreless rolled wiper products are known in the prior art. Generally, such prior art coreless rolled wiper products may be described as being either large roll diameter products or small roll diameter products. Small diameter rolls have an outside diameter in the range of from about 4 inches to about 6 inches, and large diameter rolls have an outside diameter of from about 8 inches to about 12 inches. Small diameter coreless rolls typically have an initial inside diameter of about 1.5 inches, while large diameter coreless rolls typically have an initial inside diameter of about 3.0 inches.

There are a variety of compressed rolled sanitary paper products known in the prior art. Most of the references teaching such products are directed, primarily, to methods in/or apparatus for compressing the rolls. Generally speaking, such rolls are reshaped in a generally round configuration by the end user. Examples of such references include U.S. Pat. No. 4,886,167 to Dearwester, U.S. Pat. No. 4,909,388 to Watanabe, U.S. Pat. No. 4,762,061 to Watanabe, et al., U.S. Pat. No. 5,027,582 to Dearwester, U.S. Pat. No. 5,186,099 to Qing, et al., and U.S. Pat. No. 5,195,300 to Kovacs, et al.

U.K. Patent Application No. GB2244472A teaches a tissue dispenser for coreless rolls of tissue wherein the roll may be unidirectionally compressed within the dispenser. The tissue is dispensed in its compressed configuration.

U.S. Pat. Nos. 325,410 to Hicks and 1,819,895 to Hunt each teach flattened rolls of toilet tissue wherein the paper is removed from the outside of the roll when the roll is in its flattened condition.

Although some of the above cited prior art teaches a space saving feature, that space saving feature is directed to the shipping and storage of the products. That advantage, therefore, is no longer present for the end user during actual dispensing. Further, the centerflow rolled wipers generally have a roping problem associated therewith at least during the initial stages of dispensing when the diameter of the hole in the center of the roll is relatively small. Roping occurs when the sheet twists as it is being extracted from the center of the roll which can cause premature tearing of the perforations and dispensing failure. In addition, the twisting or roping of the wiper during dispensing may interfere with the tearing of individual sheets along the lines of perforation. The roping or twisting problem has been eliminated with larger diameter rolls by creating a correspondingly larger initial inside diameter. Of course, the larger inside diameter results in a larger outside diameter as well which means that the final product will occupy more space than it would have if the center hole was maintained at its smaller diameter. The present invention obviates the roping or twisting problem while simultaneously yielding a package which displaces less volume than a conventional centerflow roll of equal total length having the smaller diameter initial center hole.

SUMMARY OF THE INVENTION

It is therefore an object of the present invention to provide a space saving system for coreless rolled wipers wherein premature rupture of lines of perforation due to roping or twisting of the product during initial dispensing is substantially eliminated.

It is a further object of the present invention to provide a space saving system for coreless rolled wipers wherein roping of the product during initial dispensing is reduced.

Still another object of the present invention is to provide a space saving system for coreless rolled wipers wherein the total volume displacement of the roll is substantially reduced even during dispensing.

Briefly stated, the foregoing and numerous other objects, features and advantages of the present invention will become readily apparent upon reading of the detailed description, claims and drawings set forth herein. These objects, features and advantages are accomplished through forming a coreless rolled wiper product having an enlarged inside diameter and subsequently compressing that roll bi-directionally to preferably form a generally square or rectangular shape wherein the center hole is deformed such that it is partially collapsed. The center hole however is not deformed to the point where the sides thereof are in contact with one another. The compressed product is then placed into a centerflow dispensing container which is preferably disposable. That container is preferably formed of corrugated cardboard and maintains the outside shape of the bi-directionally compressed roll in its generally rectangular or square shape. The coreless rolled wiper product will generally have a basis weight of from about 20 to about 60 pounds per 2880 ft.$^2$.

DETAILED DESCRIPTION OF THE PREFERRED EMBODIMENT

Figure 1:
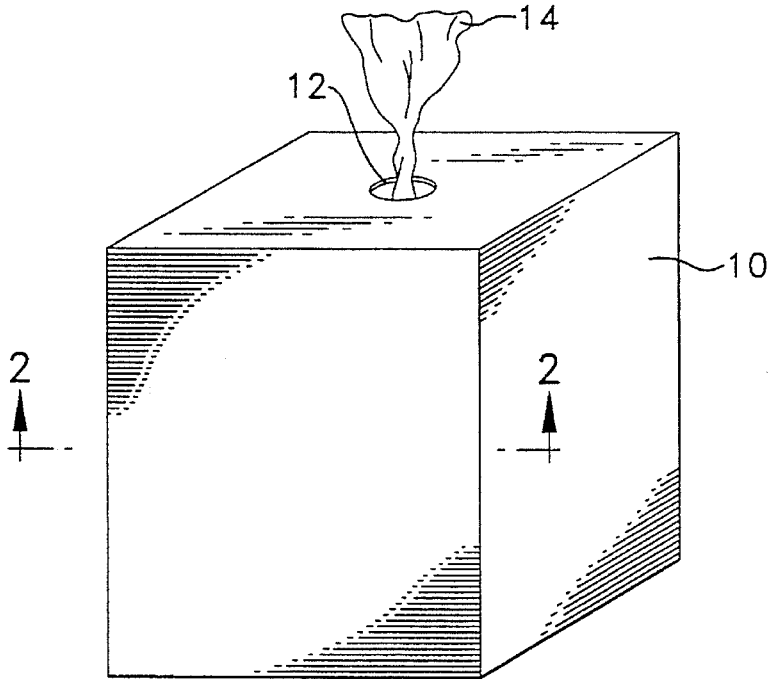
FIG. 1 PRIOR ART
FIG. 1 is a perspective view of a typical prior art roll of coreless wipers in a dispenser carton.

Turning first to FIG. 1 there is shown a perspective view of a typical prior art dispenser carton 10 for a small diameter roll of coreless wipers. The carton 10 includes a dispensing orifice 12 on one end thereof through which the wipers 14 are dispensed. The dispenser carton 10 is preferably made from corrugated cardboard and has a coreless roll of wipers 16 residing therein. Such coreless roll of wipers 16 includes an inside or centerflow hole 18 which would typically have a diameter of about 1.5 inches. The outside diameter of such coreless roll of wipers 16 would typically be in the range of from about 5 inches to about 6 inches. One example of this type of product is Scott Paper Company's current Grab-a-Rag product. The inside diameter of such product is 1.5", while the outside diameter is 5.7" plus or minus 0.3 inches. Such product is shipped in and dispensed from a dispenser carton 10 having inside cross-sectional dimensions of 6.1" by 6.1". The roll 16 is perforated defining sheets which are 10.4" long. When attempting to dispense the sheets which are about 9.5" in length or longer from the center of the coreless roll with an initial inside diameter of 1.5", the sheet twists or ropes more than two times before the next line of perforations is reached. This interferes with the tearing along the perforation line which can result in an uneven tear of the sheet from the roll. It has been found that in order to alleviate this problem, the roping factor should be less than two and, most preferably should approach one wherein the roping factor is defined as:

$$R_f = L/C$$

wherein $R_f$ is the roping factor, L is the length of each sheet between lines of perforation, and C is the inside circumference or perimeter of the centerflow hole 18. Using this formula, the roping factor, $R_f$, for the above-mentioned Grab-a-Rag product is 2.2.

Figure 2:
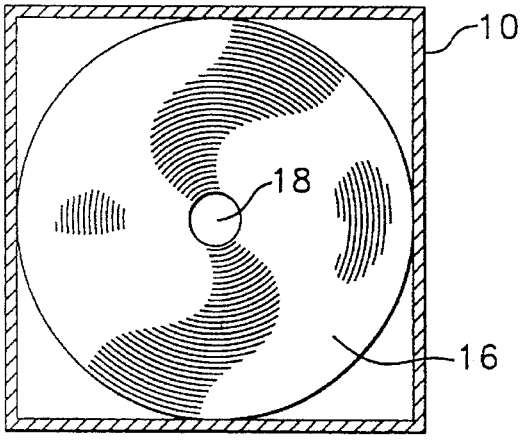
FIG. 2 PRIOR ART
FIG. 2 is a cross sectional view taken along line 2—2 of FIG. 1.
Figure 3:
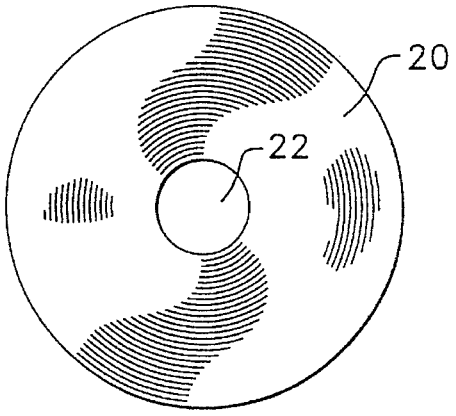
FIG. 3 is an end view of the roll of the present invention prior to being bi-directionally compressed.

Assuming that FIG. 2 is a cross-sectional view of a coreless roll 10 wiper product having an inside diameter of 1.5" and an outside diameter of 5.82" with the sheet length being 10.4", that same product can be configured for easier dispensing in an improved roll 20 as depicted in FIG. 3. Such improved roll 20 has a centerflow hole 22 with an initial inside diameter 3" and an outside diameter of 6.37". With such a change in configuration, the roping factor, $R_f$, has been reduced from 2.2 for the roll configuration of FIG. 2 versus 1.1 for the roll configuration of FIG. 3. The only drawback to the improved roll 20 is that its cross-sectional area has been increased.

Figure 4:
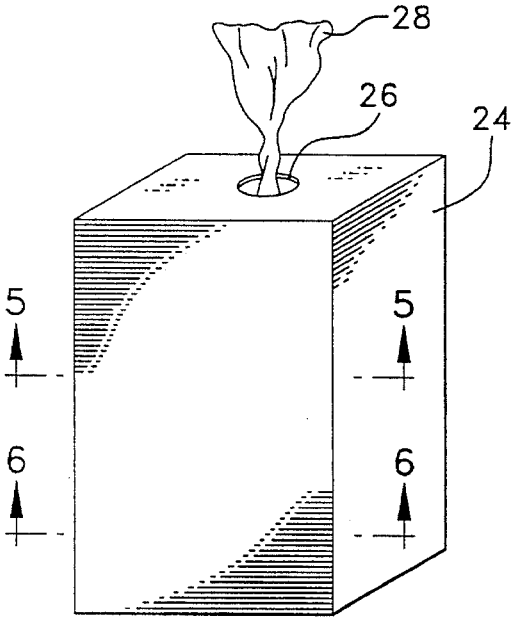
FIG. 4 is a perspective view of the space saving system for coreless rolled wipers of the present invention.

Particularly with its enlarged center hole 22, improved roll 20 is subject to being compressed such that it can be placed within the dispenser carton 24 of reduced volume as depicted in FIG. 4. Dispenser carton 24 includes a dispensing orifice 26 through wipers 28 can be dispensed. The improved roll 20, in such compressed configuration, can be inserted in a dispensing carton 24 having inside cross sectional dimensions which are each less than the original outside diameter of the roll 20. Improved roll 20 is thus retained in the generally rectangular configuration depicted in FIG. 5 wherein dispenser carton 24 has inside cross sectional dimensions of 5.375" by 4.625". Compare this to a roll 16 containing the same total length of web configured as shown in FIG. 2. Even if the carton 10 is sized for zero tolerance, the inside cross sectional dimensions of the carton 10 are 5.82" by 5.82". Thus the cross dimensions of the carton 10 are 5.82" by 5.82". Thus the cross sectional area of the dispenser carton 10 is 33.87 in.$^2$ whereas cross sectional area of the dispenser carton 24 is 24.86 in.$^2$. The net result is the inside cross-sectional area of the carton dispenser has been reduced by more than 26.6% while simultaneously eliminating the roping problem associated with initial dispensing of the sheets from the coreless roll 16.

Figure 5:
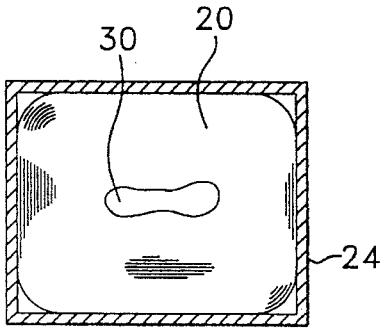
FIG. 5 is a cross sectional view taken along line 5—5 of FIG. 4.
Figure 6:
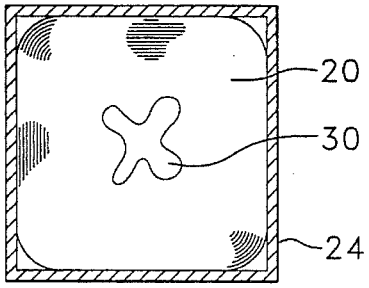
FIG. 6 is a cross sectional view taken along line 6—6 of FIG. 4 assuming the dispenser carton of FIG. 4 was square in cross section.

In compressing the improved roll 20, the configuration preferably becomes generally rectangular, perhaps even square if desired. With the outside of the roll being so configured, the centerflow hole 20 becomes deformed and is, of course, no longer round. If the improved roll is generally rectangular in shape, then the deformed centerflow hole 30 will have somewhat of a dog-bone type shape as depicted in FIG. 5. If the improved roll 20 is compressed such that it is generally square in cross-section then the deformed centerflow hole 30 will have somewhat of a rounded X-shape in cross section as depicted in FIG. 6. In either case, when compressing improved roll 20, it is important to ensure that the improved roll 20 is not so compressed that the opposing sides of the centerflow hole 20 come in contact with one another. Such contact would yield additional drag on the sheet as it is being pulled from the roll by the user potentially causing premature rupture of a line of perforations or tearing the sheet at a place other than along the line of perforations. It should be understood that although the deformed centerflow holes 30 depicted in FIGS. 5 and 6 no longer have the same inside diameter as the centerflow hole 22 did prior to compression as depicted in FIG. 3, the circumference or perimetric dimension of centerflow hole 22 as well as each of the deformed centerflow holes 30 will be substantially the same. Thus, the roping factor is the same for all three configurations of the improved roll 18. Further, the volume of each dispenser carton 24 is significantly reduced as compared to dispenser carton 10 and such reduced volume dispenser cartons 24 yields benefits to everyone from the manufacturer through to the end user. The manufacturer, of course, reduces the amount of packaging material required and reduces shipping costs with each package having a reduced volume. The retail seller or distributor gets the benefit of utilizing less shelf space with the reduced volume package. In addition, because the improved roll 18 dispenses from the reduced volume carton, the reduced volume benefit is passed along to the end user as well.

Figure 7:
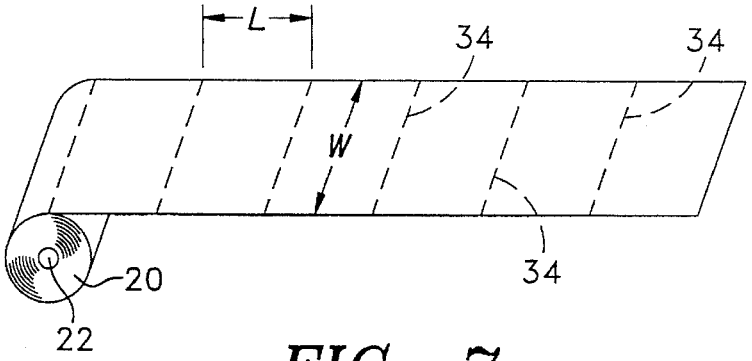
FIG. 7 is a perspective view of the roll of the present invention prior to being bi-directionally compressed with a number of sheets unwound from the outside surface thereof.

Referring to FIG. 7, the improved roll 20 is a spirally wound web 32 with an enlarged centerflow hole 22. Individual wipers 14 are defined by lines of perforation 34 with the distance between lines of perforation 34 yielding the length, L, of the each individual wiper or sheet 14. Roping problems become exacerbated the greater the width, W, of the web.

There are a number of methods known in the prior art for compressing rolled paper products. Many of such methods are discussed in the references cited in the Description of the Prior Art above. Perhaps the best way of compressing the rolls for the present invention in that they are individually boxed, is to provide convergent conveyor belts which compress the roll into the generally rectangular or square shape desired with the roll immediately being inserted from the conveyor belt into the dispenser carton. Compression must be, at least, bi-directional.

By bi-directional compression, it is meant that, looking at the roll in cross section perpendicular to the cylindrical axis of the roll, the roll is compressed along two non-colinear radii. Preferably, bi-directional compression is accomplished along two radii which intersect substantially perpendicularly with one another. For the purposes of this invention the term "at least bi-directionally compressed" includes any roll compression where the roll is compressed along a plurality of non-colinear radii where there is at least one pair of radii along which the roll has been compressed which are substantially perpendicular to one another.

Figure 8:
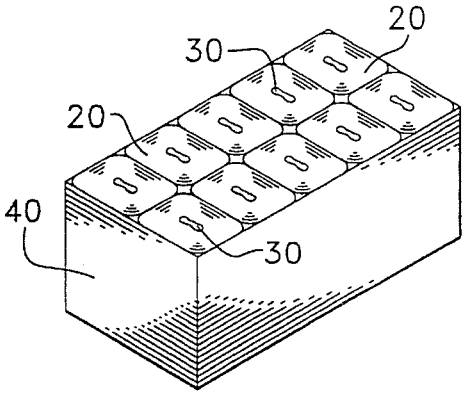
FIG. 8 is a perspective view of a case of bi-directionally compressed rolled wipers.

Although the present invention has been discussed herein as including a dispenser carton 10 which is intended to be disposable, it will be recognized by those skilled in the art that the present invention can also be practiced with a permanent dispenser such as is typically mounted on a wall. In such manner, multiple bi-directionally compressed or improved rolls 20 having deformed centerflow holes 30 would be shipped in a single case 40 (see FIG. 8). The user would have a centerflow dispenser in which individual rolls 20 would placed for dispensing. The centerflow dispenser would, of course, have to be sized so as the generally rectangular cross section of the bi-directionally compressed rolled web.

From the foregoing, it will be seen that this invention is one well adapted to attain all of the ends and objects hereinabove set forth together with other advantages which are apparent and which are inherent to the system.

It will be understood that certain features and sub-combinations are of utility and may be employed with reference to other features and sub-combinations. This is contemplated by and is within the scope of the claims.

As many possible embodiments may be made of the invention without departing from the scope thereof, it is to be understood that all matters herein set forth were shown in the accompanying drawings is to be interpreted as illustrative and not in a limiting sense.

What is claimed is:

1. A centerflow rolled wiper system comprising:

(a) a coreless rolled web having a centerflow hole, said coreless rolled web including a plurality of wipers defined by lines of perforation across the width of said web, each of said wipers having a length L;

(b) an initial center hole through said coreless rolled web having a cross-sectional perimetric dimension which is less than two times L, said coreless rolled web having been bi-directionally compressed to a generally rectangular cross section;

(c) a dispenser carton in which said bi-directionally compressed rolled web resides, said dispenser carton sized to maintain said generally rectangular cross section of said bi-directionally compressed rolled web;

(d) a dispensing port through at least one end of said dispenser carton through which a user can withdraw said wipers from the centerflow hole of said coreless rolled web.

2. A centerflow rolled wiper system comprising:

(a) a spirally wound roll of wipers having no core, each of said wipers of said spirally wound roll having a length L defined by lines of perforation across the width of said web, said spirally wound roll of wipers having been bi-directionally compressed into a generally rectangular cross section, said spirally wound roll of wipers having an initial centerflow hole having a cross-sectional perimetric dimension C which is great enough to yield a roping factor $R_f$ which is less than 2 wherein $$R_f=L/C;$$

(b) a dispenser in which said spirally wound roll of wipers resides, said dispenser sized to maintain said generally rectangular cross section of said spirally wound roll of wipers;

(c) a dispensing port through at least one end of said dispenser through which a user can withdraw individual ones of said wipers from the center of said spirally wound roll of wipers.

3. A centerflow rolled wiper system as recited in claim 2 wherein:

said bi-directionally compressed, spirally wound roll of wipers has a cross-sectional area which is less than the cross-sectional area of said bi-directionally compressed, spirally wound roll of wipers prior to the bi-directional compression thereof.

4. A centerflow rolled wiper system as recited in claim 2 wherein:

said centerflow hole of said bi-directionally compressed, spirally wound roll of wipers has not been so collapsed that the sides thereof are in contact with one another.

5. A centerflow rolled wiper system comprising:

(a) a bi-directionally compressed, spirally wound roll of wipers having no core, said bi-directionally compressed, spirally wound roll of wipers having a generally rectangular cross section, each of said wipers of said bi-directionally compressed, spirally wound roll having a length L defined by lines of perforation across the width of said web, said bi-directionally compressed, spirally wound roll of wipers having a centerflow hole with a cross-sectional perimetric dimension C which is great enough to yield a roping factor $R_f$ which is less than 2 wherein $$R_f=L/C;$$

(b) a dispenser carton in which said bi-directionally compressed, spirally wound roll of wipers resides, said dispenser carton sized to maintain said generally rectangular cross section of said bi-directionally compressed,, spirally wound roll of wipers;

(c) a dispensing port through at least one end of said dispenser carton through which a user can withdraw individual ones of said wipers from the center of said bi-directionally compressed, spirally wound roll of wipers.

6. A centerflow rolled wiper system as recited in claim 5 wherein:

said bi-directionally compressed, spirally wound roll of wipers has a cross-sectional area which is less than the cross-sectional area of said bi-directionally compressed, spirally wound roll of wipers prior to the bi-directional compression thereof.

7. A centerflow rolled wiper system as recited in claim 5 wherein:

said centerflow hole of said bi-directionally compressed, spirally wound roll of wipers has not been so collapsed that the sides thereof are in contact with one another.

* * * * *